US005788298A

United States Patent [19]

Cheng

[11] Patent Number: 5,788,298

[45] Date of Patent: Aug. 4, 1998

[54] DETACHABLE CUP HANDLE FOR DISPOSABLE CUPS

[76] Inventor: Cheng-Chang Cheng, 6F., No. 139, Pao An Road, Yung Ho City, Taipei Hsien, Taiwan

[21] Appl. No.: 870,278

[22] Filed: Jun. 6, 1997

[51] Int. Cl.[6] ..... B65D 25/28

[52] U.S. Cl. ..... 294/27.1; 294/33; 220/738

[58] Field of Search ..... 294/27.1, 29, 30, 294/31.1, 33; 220/737, 738, 741, 742; D7/393, 394, 622; 215/395, 396; 16/114 R

[56] References Cited

U.S. PATENT DOCUMENTS

| | | | |
|---|---|---|---|
| D. 195,985 | 8/1963 | Scherrer et al. | D7/622 |
| 256,983 | 4/1882 | Davis | 294/33 |
| 1,133,420 | 3/1915 | Young | 294/33 |
| 2,029,429 | 2/1936 | Koons | 294/27.1 |
| 2,630,244 | 3/1953 | Brock | 294/33 |
| 3,261,633 | 7/1966 | Sakuta | 294/33 |

*Primary Examiner*—Dean Kramer
*Attorney, Agent, or Firm*—Varndell Legal Group

[57] ABSTRACT

A detachable cup handle injection molded from plastic and adapted for securing a disposable cup for conveniently carrying the cup by hand. The detachable cup handle has a curved hand grip section for the holding of the hand, a vertical support section extended from a bottom end of the hand grip section and adapted for attaching to the periphery of the disposable cup to support the cup handle, and a retainer section extended from a top end of the hand grip section and defining with a top end of the support section a clamping space for clamping on the rim of the disposable cup.

1 Claim, 5 Drawing Sheets

DETACHABLE CUP HANDLE FOR DISPOSABLE CUPS

BACKGROUND AND SUMMARY OF THE INVENTION

The present invention relates to a detachable cup handle adapted for securing to a disposable cup to make it more convenient for carrying by hand.

In hospitals, offices, factories, public facilities, etc., disposable paper or plastic cups are frequently provided for holding drinking water from, for example, a drinking fountain. In order to minimize manufacturing cost, regular disposable cups do not have a handle for carrying. A disposable cup with no handle is not suitable for holding hot water, because heat is directly transmitted through the thin wall of the cup to the user's hand, causing discomfort to the user's hand or even scalding.

The present invention has been accomplished in view of the above circumstances. It is the main object of the present invention to provide a detachable cup handle which can be conveniently and detachably fastened to a disposable cup to make the cup more convenient for carrying by hand. It is another object of the present invention to provide a detachable cup handle which permits the user to carry a disposable cup for holding hot water without touching the cup body directly. According to one aspect of the present invention, the detachable cup handle comprises a curved hand grip section for the holding of the hand, a vertical support section extended from a bottom end of the hand grip section and adapted for attaching to the periphery of the disposable cup to support the cup handle, and a retainer section extended from a top end of the hand grip section and defining with a top end of the support section a clamping space for clamping on the rim of the disposable cup. According to another aspect of the present invention, the disposable cup handle is injection molded from plastic so that its manufacturing cost is low. According to still another aspect of the present invention, a stick extends downwardly from the bottom end of the support section, such that the detachable cup handle can be used as a stirrer for stirring, for example, sugar in tea.

DETAILED DESCRIPTION OF THE PREFERRED EMBODIMENT

Figure 1:
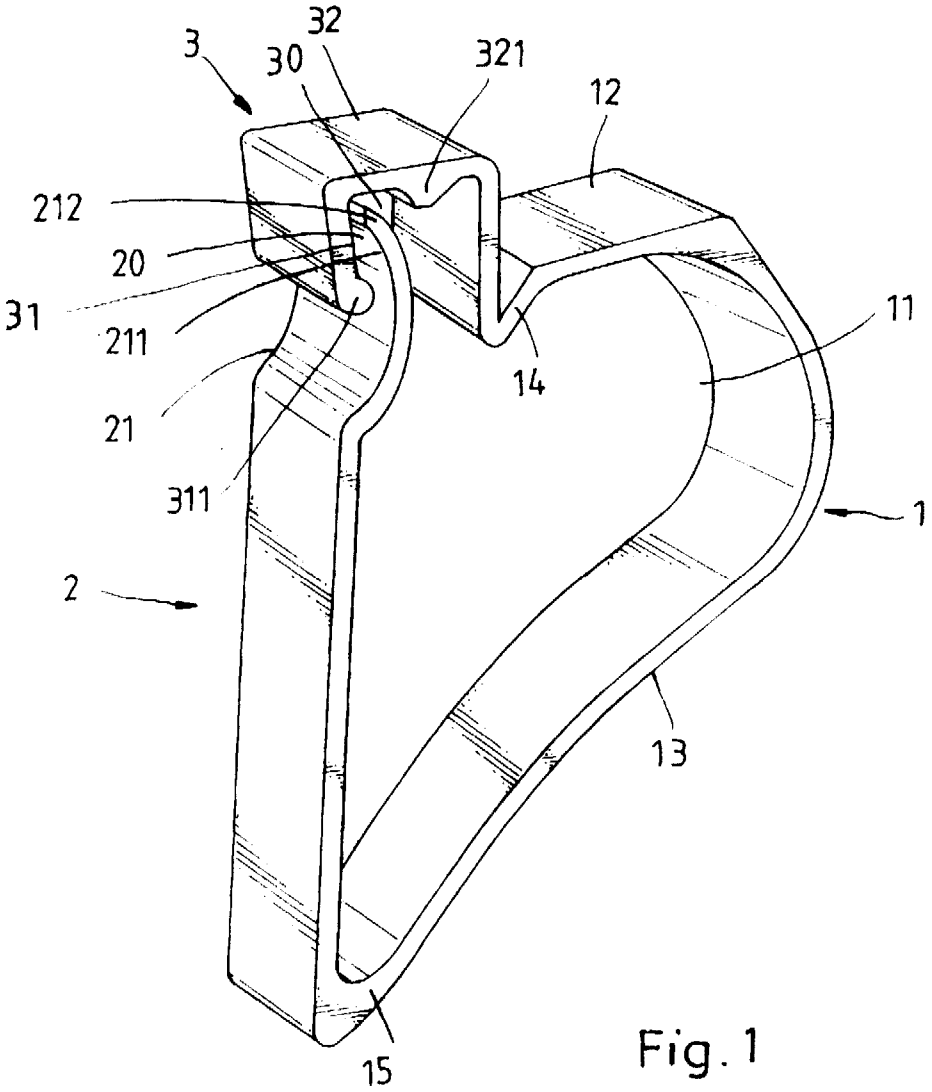
FIG. 1 is an elevational view of a detachable cup handle according to the present invention.
Figure 2:
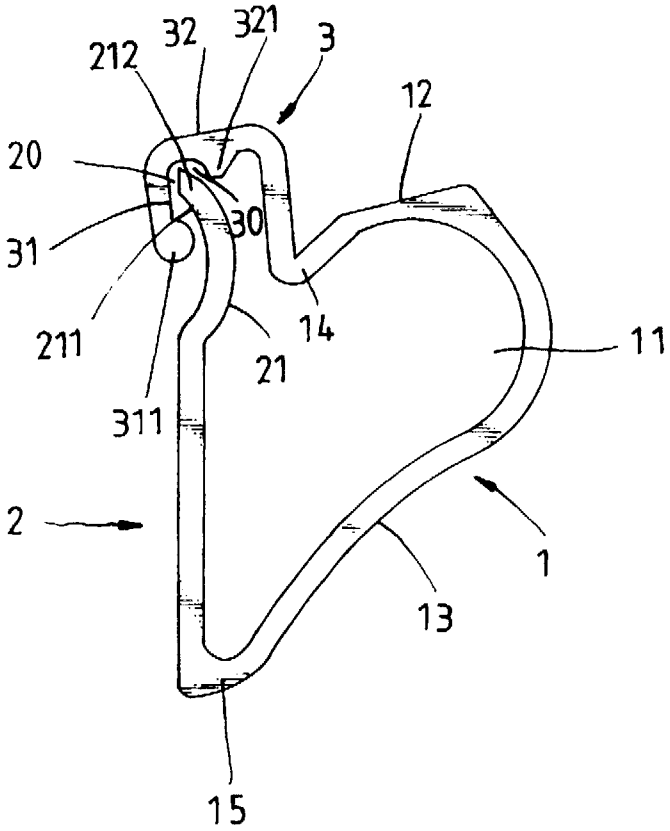
FIG. 2 is a side view of the detachable cup handle shown in FIG. 1.

Referring to FIGS. 1 and 2, a detachable cup handle in accordance with the present invention is adapted for securing to a disposable cup to make it convenient for carrying by hand, comprising a hand grip section 1, a support section 2, and a retainer section 3. The detachable handle is preferably injection molded from plastic for the advantage of low manufacturing cost.

The hand grip section 1 comprises a front connecting portion 14 at one end connected to one end of the retainer section 3, a rear connecting portion 15 at an opposite end connected to one end of the support section 2, a curved bearing portion 13 connected between the rear connecting portion 15 and the front connecting portion 14 and defining with the support section 2 a space 11, and a thumb rest portion 12 horizontally connected between the front connecting portion 14 and the curved bearing portion 13.

The retainer section 3 comprises a U-shaped wall portion with an angle wall portion 32 extended vertically upwardly from the front connecting portion 14 of the hand grip section 1 (defining a first leg of the U-shaped wall), and then turned horizontally forwards (defining a base of the U-shaped wall), a smoothly curved flange 311 (defining a second leg of the U-shaped), a vertical clamping wall portion 31 connected between the angle wall portion 32 and the smoothly curved flange 311, and a transverse rib 321 raised from the angle wall portion 32 at an inner side adjacent to the vertical clamping wall portion 31.

The support section 2 is vertically extended from the rear connecting portion 15 of the hand grip section 1, having a top end terminating in substantially arched clamping wall portion 21 and inserted into the space defined between the vertical clamping wall portion 31 and angle wall portion 32 of the retainer section 3. The arched clamping wall portion 21 has a front side 211 spaced from the vertical clamping wall portion 31 of the retainer section 3 by a clamping space 20, and a top edge 212 spaced from the transverse rib 321 of the retainer section 3 by a gap 30.

Figure 3:
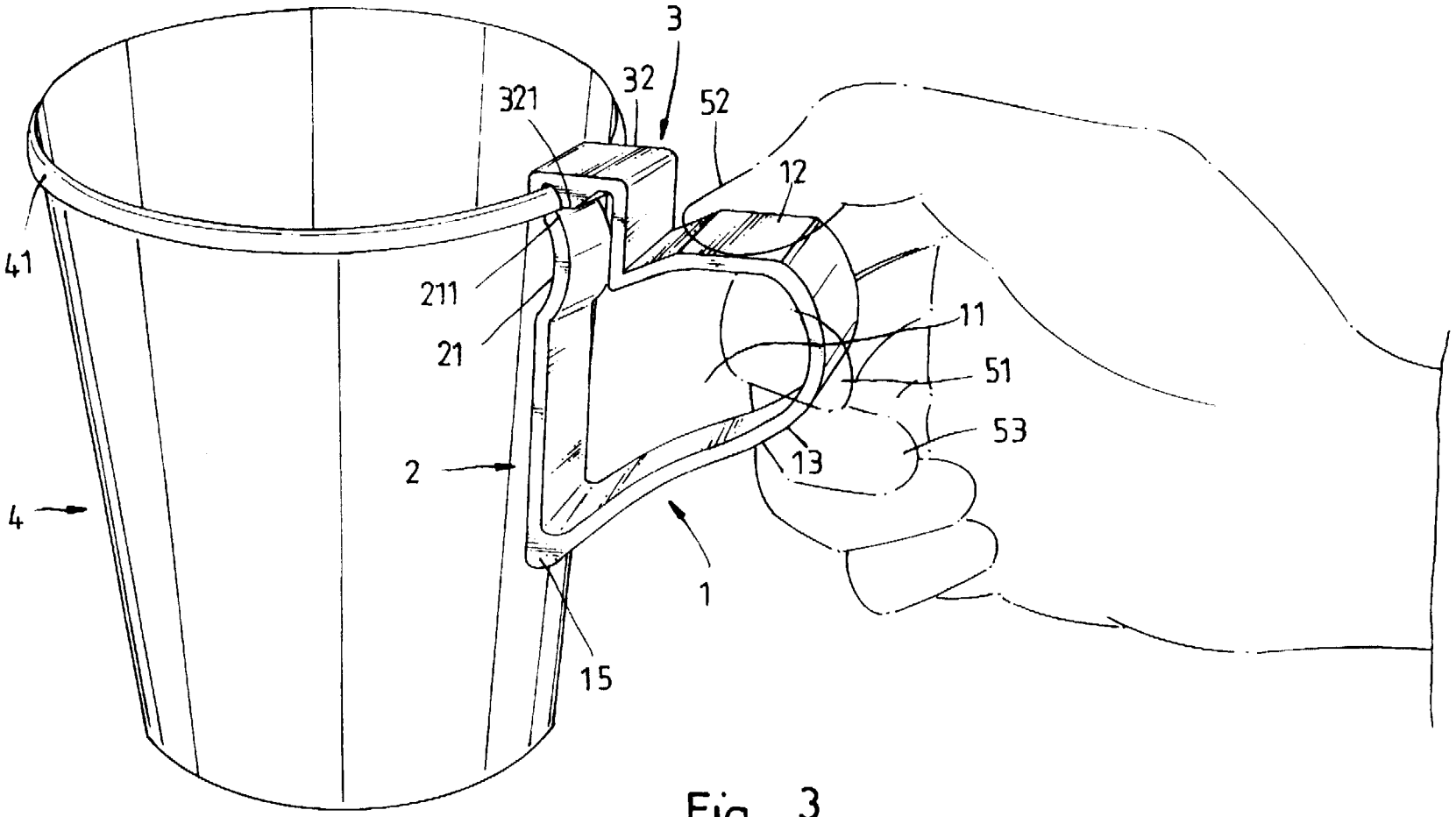
FIG. 3 is an applied view of the present invention, showing the disposable cup handle secured to a detachable cup and held in the user's hand.
Figure 5:
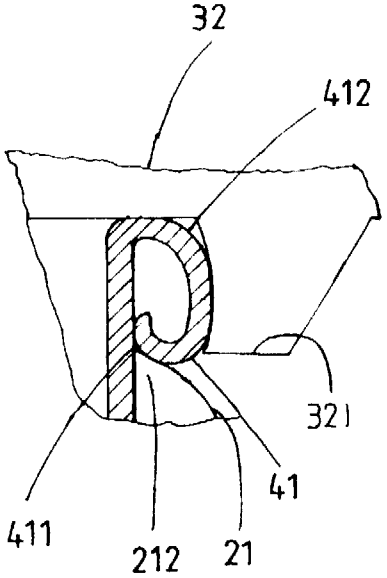
FIG. 5 is an enlarged view showing the rim of the cup retained between the top edge of the arched clamping wall portion of the support section and the transverse rib of the retainer section.
Figure 4:
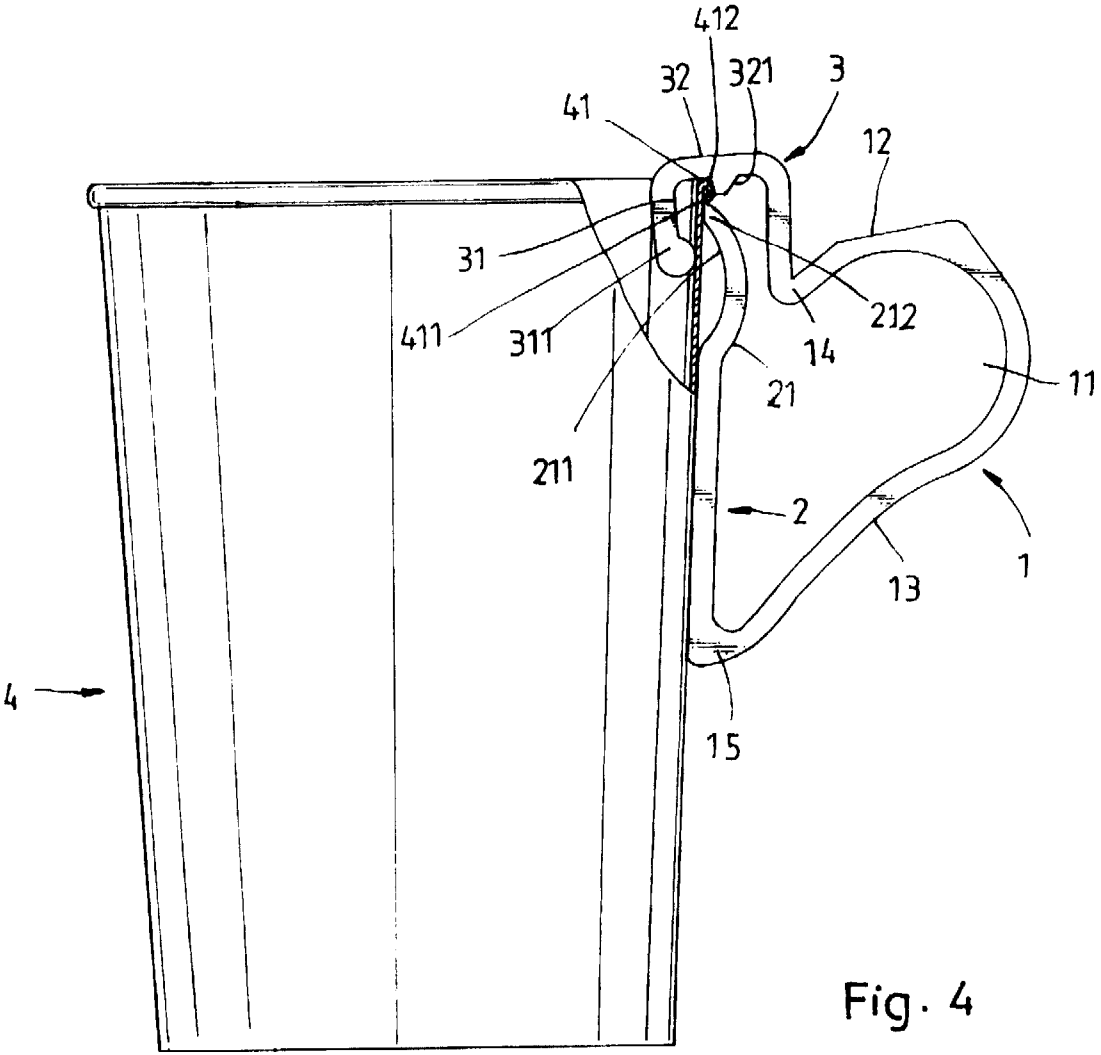
FIG. 4 is a sectional side view showing the detachable cup handle fastened to a disposable cup according to the present invention.
Figure 6:
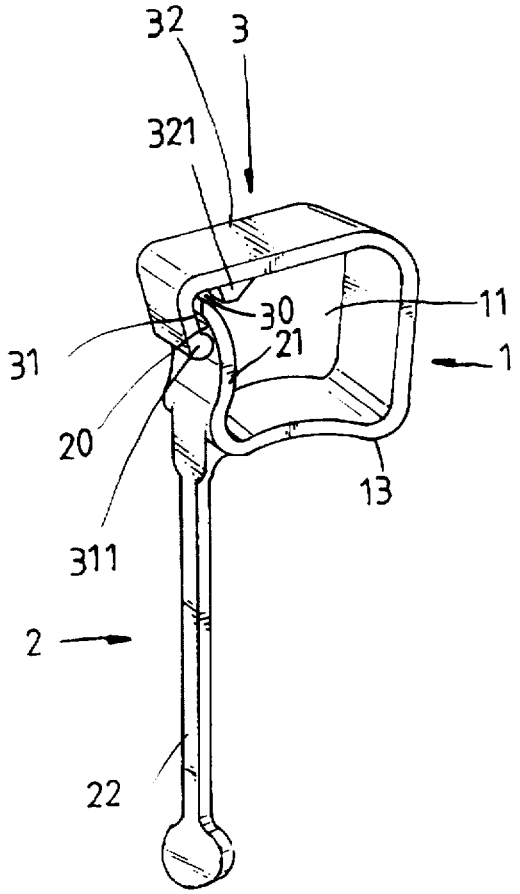
FIG. 6 is an elevational view of a detachable cup handle according to an alternate form of the present invention.

Referring to FIGS. 3, 4 and 5, when in use, the detachable handle is fastened to a disposable cup 4 by forcing the rim 41 of the disposable cup 4 into the clamping space 20 between the arched clamping wall portion 21 of the support section 2 and the vertical clamping wall portion 31 of the retainer section 3, permitting the support section 2 to be closely attached to the periphery of the disposable cup 4. When installed, the top edge 212 of the arched clamping wall portion 21 of the support section 2 abuts the bottom side 411 of the rim 41 of the disposable cup 4, the transverse rib 321 abuts an outer side 412 of the rim 41 of the disposable cup 4, and curved flange 311 of the vertical clamping wall portion 31 of the retainer section 3 is clamped on the inside wall of the disposable cup 4. When holding the disposable cup 4, the thumb 52 is pressed on the thumb rest portion 12 of the hand grip section 1, the forefinger 51 is inserted through the space 11, and the middle finger 53 is stopped at an outer side of the bearing portion 13 of the hand grip section 1. FIG. 6 shows an alternate form of the present invention, in which the bottom end of the support section 2 terminates in a stick 22 for stirring, for example, sugar in tea.

I claim:

1. A detachable cup handle adapted for fastening to a rim of a disposable cup for carrying said disposable cup by hand, comprising a hand grip section, a retainer section and a support section; said hand grip, retainer and support sections are integrally formed of a single plastic material:

said hand grip section having a front connecting portion at one end, a rear connecting portion at an opposite end, a thumb rest portion horizontally extending from said front connecting portion, and a curved bearing portion extending between said thumb rest portion and said rear connecting portion;

said retainer section having an inverted U-shaped wall portion defined by first and second legs connected together with a base, said first leg of U-shaped wall extending upward from said front connecting portion of said hand grip section, said second leg of U-shaped wall angled inwardly toward said first leg and terminating with a curved flange, and said base of U-shaped wall including a transverse rib extending downward, a side of said transverse rib facing said second leg of U-shaped wall having a concave surface relative to said second leg of U-shaped wall; and said support section having a bottom end connected to said rear connecting portion of said hand grip section and a top end terminating in an arched clamping portion, said arched clamping portion extending upward and terminating between said transverse rib and said second leg of said inverted U-shaped wall portion of said retainer section, said arched clamping portion having a shape of a concavely curved wall relative to said first leg of said U-shaped wall of said retainer section;

wherein said detachable cup handle holds said disposable cup by said rim of said disposable cup abutting both said concave surface of said transverse rib of said base of said U-shaped wall and said arched clapping portion of said support section while said curved flange of said retainer section abuts a wall of said disposable cup adjacent said arched clamping portion.

* * * * *